US007033123B2

(12) United States Patent
Trovinger

(10) Patent No.: US 7,033,123 B2
(45) **Date of Patent: *Apr. 25, 2006**

(54) BOOKLET MAKER

(75) Inventor: Steven W. Trovinger, Los Altos, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 154 days.

This patent is subject to a terminal disclaimer.

(21) Appl. No.: 10/084,460

(22) Filed: Feb. 28, 2002

(65) Prior Publication Data

US 2003/0161704 A1 Aug. 28, 2003

(51) Int. Cl.
*B42B 1/02* (2006.01)

(52) U.S. Cl. ..... 412/33; 412/32; 270/52.26; 270/52.29; 270/52.3; 270/53

(58) Field of Classification Search ..... 412/33, 412/32; 270/52.26, 52.29, 52.3, 53
See application file for complete search history.

(56) References Cited

U.S. PATENT DOCUMENTS

| | | | | |
|---|---|---|---|---|
| 3,774,901 | A * | 11/1973 | McCain et al. | 270/52.29 |
| 4,053,150 | A | 10/1977 | Lane | |
| 4,083,551 | A * | 4/1978 | St. Denis | 270/52.18 |
| 4,085,927 | A * | 4/1978 | Muller | 270/52.29 |
| 4,410,170 | A * | 10/1983 | Wertheimer et al. | 270/37 |
| 4,482,141 | A * | 11/1984 | Moser | 198/644 |
| 4,489,930 | A * | 12/1984 | Meier | 270/52.3 |
| 4,518,156 | A * | 5/1985 | Moser | 270/52.14 |
| 4,595,187 | A | 6/1986 | Bober | |
| 4,641,825 | A * | 2/1987 | Mowry et al. | 270/52.26 |
| 4,684,116 | A * | 8/1987 | Hansch | 270/52.3 |
| 4,732,374 | A * | 3/1988 | Honegger | 270/52.3 |
| 4,735,406 | A * | 4/1988 | Weber | 270/52.3 |
| 4,891,681 | A | 1/1990 | Fiske et al. | |
| 5,005,815 | A * | 4/1991 | Auksi | 270/1.02 |
| 5,013,019 | A * | 5/1991 | Samuels | 270/1.02 |
| 5,052,666 | A * | 10/1991 | Hansch | 270/52.3 |
| 5,052,667 | A * | 10/1991 | Hansch | 270/52.3 |
| 5,087,163 | A | 2/1992 | Erdbories et al. | |
| 5,100,118 | A * | 3/1992 | Hobbs et al. | 270/52.17 |
| 5,104,108 | A * | 4/1992 | Honegger | 270/52.3 |
| 5,116,033 | A * | 5/1992 | Honegger | 270/52.3 |
| 5,292,110 | A * | 3/1994 | Honegger | 270/52.26 |
| 5,324,014 | A * | 6/1994 | Honegger et al. | 270/52.3 |
| 5,346,350 | A | 9/1994 | Luhman et al. | |
| 5,377,965 | A * | 1/1995 | Mandel et al. | 270/37 |
| 5,417,410 | A * | 5/1995 | Meier | 270/52.18 |
| 5,452,920 | A | 9/1995 | Parker | |
| 5,464,199 | A * | 11/1995 | Stauber | 270/52.18 |
| 5,465,213 | A | 11/1995 | Ross | |
| 5,593,148 | A * | 1/1997 | Hansch | 270/52.3 |
| 5,615,871 | A * | 4/1997 | Kleinhen | 270/45 |

(Continued)

FOREIGN PATENT DOCUMENTS

EP 000569887 A1 * 12/1990

(Continued)

*Primary Examiner*—Boyer Ashley
*Assistant Examiner*—Mark Henderson

(57) ABSTRACT

A booklet maker, including a pivotable collecting device including two supporting sides formed as a saddle shape, and a rotatable transferring device including a displaceable clamping component, where the transferring device delivers a folded sheet material to the collecting device along a non-linear path, and where the collecting device pivots to receive the folded sheet material from the transferring device such that different portions of the folded sheet material are supported by different sides of the two supporting sides of the collecting device.

31 Claims, 15 Drawing Sheets

U.S. PATENT DOCUMENTS

| | | | | | |
|---|---|---|---|---|---|
| 5,657,978 | A | * | 8/1997 | Meier et al. | 270/52.16 |
| 5,667,211 | A | * | 9/1997 | Reist | 270/52.16 |
| 5,678,813 | A | | 10/1997 | Osako et al. | |
| 5,713,565 | A | * | 2/1998 | Meier | 270/52.16 |
| 5,758,871 | A | * | 6/1998 | Schlough | 270/52.27 |
| 5,794,926 | A | * | 8/1998 | Hansch | 270/52.26 |
| 5,810,345 | A | * | 9/1998 | Lehmann et al. | 270/52.26 |
| 5,820,325 | A | * | 10/1998 | Hartsoe | 412/1 |
| 5,975,182 | A | * | 11/1999 | Hartmann et al. | 156/538 |
| 6,099,225 | A | | 8/2000 | Allen et al. | |
| 6,193,458 | B1 | | 2/2001 | Marsh | |
| 6,251,054 | B1 | * | 6/2001 | Cruz et al. | 493/383 |
| 6,270,068 | B1 | * | 8/2001 | Cracknell | 270/52.26 |
| 6,363,851 | B1 | | 4/2002 | Gerhard et al. | |
| 6,375,179 | B1 | * | 4/2002 | Boss et al. | 270/52.27 |
| 6,517,064 | B1 | * | 2/2003 | Glanzmann | 270/52.28 |
| 6,550,756 | B1 | * | 4/2003 | Trovinger | 270/52.26 |
| 6,554,267 | B1 | * | 4/2003 | Trovinger | 270/52.18 |
| 6,578,838 | B1 | * | 6/2003 | Trovinger et al. | 270/52.18 |
| 6,612,559 | B1 | * | 9/2003 | Boss | 270/52.18 |
| 6,632,061 | B1 | * | 10/2003 | Trovinger | 412/11 |
| 6,673,002 | B1 | | 1/2004 | Trovinger et al. | |
| 6,682,285 | B1 | | 1/2004 | Trovinger et al. | |
| 6,708,967 | B1 | | 3/2004 | Trovinger et al. | |
| 6,796,554 | B1 | * | 9/2004 | Trovinger | 270/52.26 |
| 2002/0140154 | A1 | * | 10/2002 | Trovinger | 270/58.08 |
| 2002/0141849 | A1 | | 10/2002 | Trovinger et al. | |
| 2003/0069117 | A1 | | 4/2003 | Trovinger et al. | |
| 2003/0069118 | A1 | | 4/2003 | Trovinger et al. | |
| 2003/0069119 | A1 | | 4/2003 | Trovinger et al. | |
| 2003/0161705 | A1 | * | 8/2003 | Trovinger | 412/25 |
| 2003/0162644 | A1 | * | 8/2003 | Trovinger | 493/405 |
| 2003/0214092 | A1 | * | 11/2003 | Horii et al. | 270/52.18 |
| 2004/0041326 | A1 | | 3/2004 | Trovinger | |
| 2004/0048728 | A1 | | 3/2004 | Trovinger et al. | |
| 2004/0052613 | A1 | * | 3/2004 | Trovinger | 412/3 |
| 2005/0077671 | A1 | * | 4/2005 | Trovinger | 270/52.26 |

FOREIGN PATENT DOCUMENTS

| | | | |
|---|---|---|---|
| EP | 0992365 | | 4/2000 |
| WO | 00/18583 | | 4/2000 |
| WO | WO 00/18583 | * | 4/2000 |
| WO | WO 03/031302 | * | 4/2003 |
| WO | WO 03/031304 | * | 4/2003 |

* cited by examiner

BOOKLET MAKER

BACKGROUND OF THE INVENTION

1. Field of the Invention

The present invention generally relates to the handling of sheet material and, more particularly, to a booklet maker.

2. Background Information

A system for finishing printed sheets into booklets is described in U.S. Pat. No. 6,099,225 (Allen et al.), hereby incorporated by reference in its entirety, where most finishing operations are performed on a sheet-by-sheet basis using precise paper positioning. Sheet material is transported from one operation to another along a horizontal paper path. Also, the Allen patent discloses an inverted V-shaped workpiece for collecting folded booklet sheets.

Another system for making saddle-stitched booklets on a sheet-wise basis is disclosed in PCT No. WO 00/18583 (Trovinger et al.), hereby incorporated by reference in its entirety. In this system, folded booklet sheets are forwarded from a folding device to a reciprocating saddle with the use of a secondary drive system. In such a forwarding system, the path of the sheets is a straight, horizontal line, while the folded sheets are accumulated in a vertical fashion (i.e., on the saddle), that is, normal to the sheet path. A reciprocating saddle as described in the Trovinger PCT permits a trailing side of a folded sheet to be transported onto the backside of a saddle.

SUMMARY OF THE INVENTION

According to an exemplary embodiment of the present invention, a booklet maker is provided, including a pivotable collecting device including two supporting sides formed with a saddle shape, and a rotatable transferring device including a displaceable clamping component, where the transferring device delivers a folded sheet material to the collecting device along a non-linear path, and where the collecting device pivots to receive the folded sheet material from the transferring device such that different portions of the folded sheet material are supported by different sides of the two supporting sides of the collecting device.

According to another embodiment of the present invention, a method of making booklets is provided, including the steps of clamping a folded sheet material with a rotatable transferring device, delivering the folded sheet material to a pivotable collecting device along an arc established by movement of the rotatable clamping device, the folded sheet material being deposited over a supporting edge of the collecting device such that a fold of the folded sheet material is received by the supporting edge, and pivoting the collecting device such that different portions of the folded sheet material are received by different supporting sides of the collecting device.

According to another embodiment of the present invention, a system for making booklets is provided, including a folding device, a pivotable collecting device, the collecting device being saddle-shaped, a rotatable transferring device including a displaceable clamping component, where the transferring device delivers a folded sheet material to the collecting device along a non-linear path, and where the collecting device pivots to receive the folded sheet material from the transferring device such that different portions of the folded sheet material are supported by opposing sides of the collecting device, and a collecting drive for clamping a portion of the folded sheet material against the collecting device and for advancing the portion along a side of the collecting device.

BRIEF DESCRIPTION OF THE DRAWINGS

Other objects and advantages of the present invention will become more apparent from the following detailed description of preferred embodiments, when read in conjunction with the accompanying drawings wherein like elements have been represented by like reference numerals and wherein.

DETAILED DESCRIPTION OF PREFERRED EMBODIMENTS

Figure 1A:
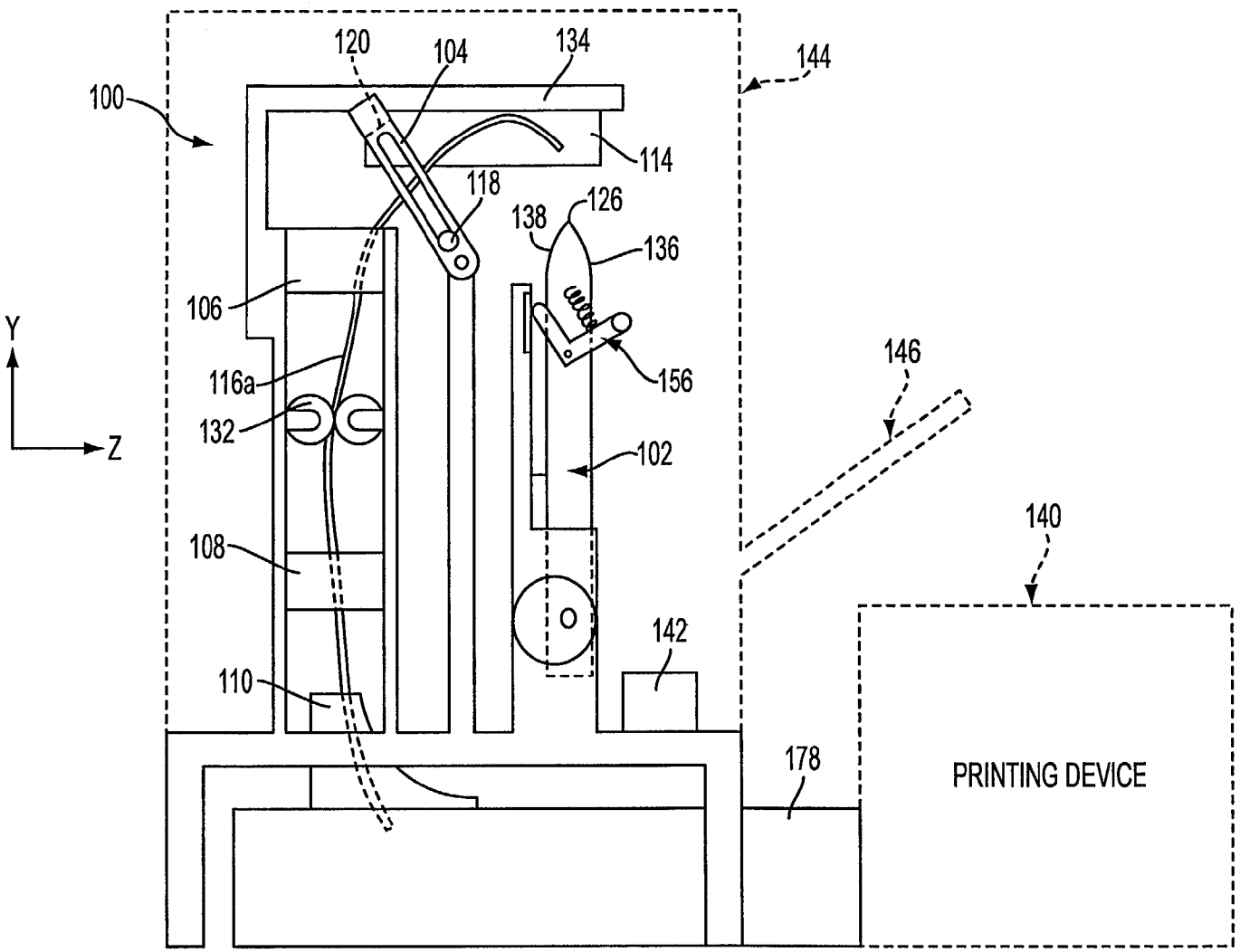
FIGS. 1A–1D are side views of a booklet maker in accordance with an exemplary embodiment of the present invention.
Figure 1B:
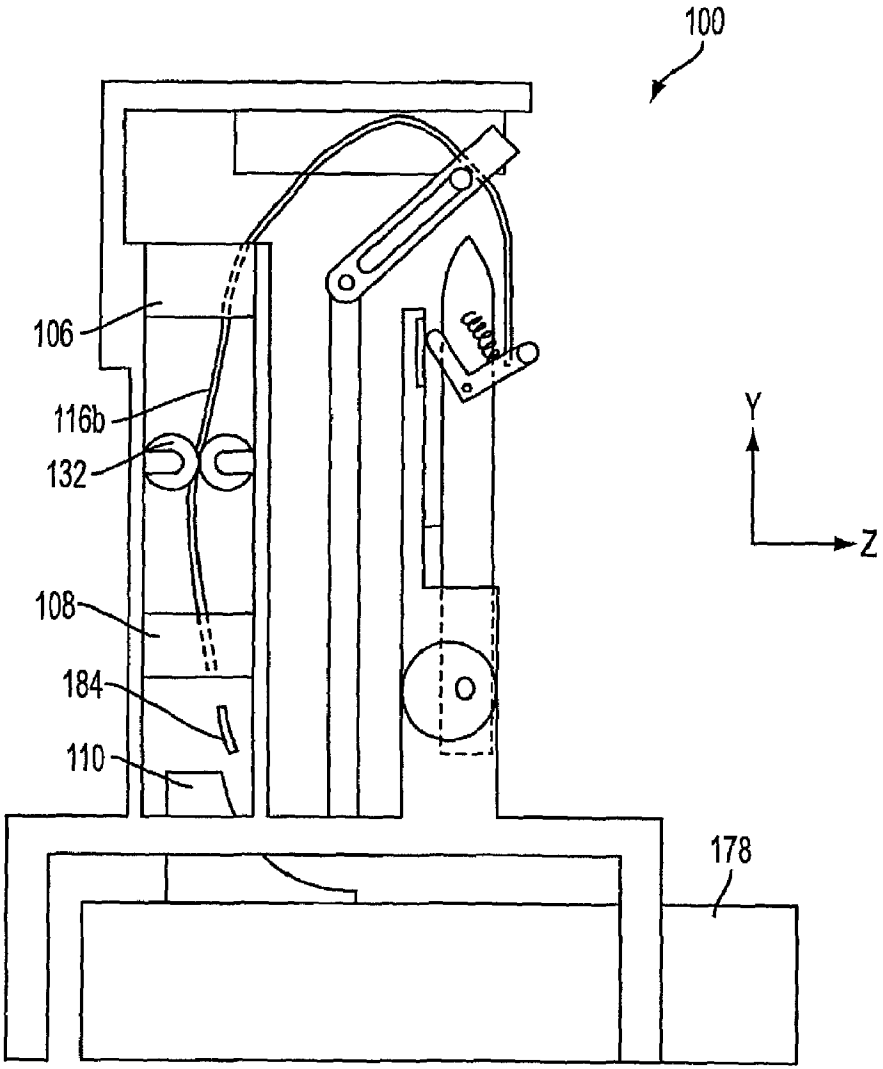

An exemplary embodiment of the present invention is represented in FIGS. 1A–1D as booklet maker 100. Booklet maker 100 can be used to create booklets by handling sheet material on an individual basis. For example, instead of processing a stack of sheet material simultaneously, the exemplary booklet maker can process or handle each individual sheet material such that a final booklet is produced with desirable characteristics (e.g., flush edges). Also, booklet maker 100 can be arranged, as shown in FIGS. 1A–1D, such that the path of each sheet material is substantially in a vertical direction (e.g., along the y-axis in the Figures). For example, each sheet material 116 travels through devices 108, 132, and 106 substantially in the +y direction and is redirected by transferring device 104 to move in the –y direction. In an exemplary embodiment, the +y direction is against the force of gravity. However, exemplary embodiments of the present invention can be configured by orienting booklet maker 100 in any direction. During an exemplary booklet making operation, a sheet material can assume three different states: original, trimmed, and folded; suffixes "a", "b", and "c" are used, respectively to indicate each state. When an indicating number corresponding to sheet material does not contain a suffix (e.g., sheet material 116), then any or all of the states are referenced. Exemplary embodiments of the present invention provide for the precise handling of individual sheet material to form booklets in a compact and efficient manner. In a non-limiting example, booklet maker 100 can be arranged as a desktop tower unit, similar in size to a personal computer or a desktop printer.

In an exemplary embodiment, a pivotable collecting device (e.g., collecting device 102 in FIG. 1A) includes two supporting sides (e.g., first supporting side 136 and second supporting side 138) formed with a saddle shape.

Exemplary embodiments of the present invention can be modified to include features from any or all of the following copending applications, the disclosures of which are hereby incorporated by reference in their entirety:

BOOKLET MAKER WITH SHEET WISE TRIM, U.S. patent application Ser. No. 09/820,739, filed Mar. 30, 2001 ("Co-Pending application 1");

SHEET-WISE HOLE PUNCHING AFTER FOLDING IN BOOKLET MAKER, U.S. patent application Ser. No. 09/820,742, filed Mar. 30, 2001 (Co-Pending application 2");

SHEET COLLECTING APPARATUS WITH INTEGRATED STAPLE MECHANISM, U.S. patent application Ser. No. 09/820,741, filed Mar. 30, 2001 ("Co-Pending application 3");

STAPLING APPARATUS FOR A BOOKLET MAKER, U.S. patent application Ser. No. 09/820,743, filed Mar. 30, 2001 ("Co-Pending application 4");

APPARATUS FOR ADVANCEMENT OF PAPER IN A NON-LINEAR PATH, U.S. patent application Ser. No. 09/820,740, filed Mar. 30, 2001 ("Co-Pending application 5");

SHEET FOLDING APPARATUS WITH PIVOT ARM FOLD ROLLERS, Trovinger et al., U.S. patent application Ser. No. 09/970,877, filed Oct. 5, 2001 ("Co-Pending application 6");

SHEET FOLDING APPARATUS, Trovinger et al., U.S. patent application Ser. No. 09/970,730, filed Oct. 5, 2001 ("Co-Pending application 7");

THICK MEDIA FOLDING METHOD, Trovinger et al., U.S. patent application Ser. No. 09/970,748, filed Oct. 5, 2001 ("Co-Pending application 8");

VARIABLE MEDIA THICKNESS FOLDING METHOD, Trovinger et al., U.S. patent application Ser. No. 09/971,351, filed Oct. 5, 2001 ("Co-Pending application 9");

SHEET FOLDING APPARATUS WITH ROUNDED FOLD BLADE, Trovinger et al., U.S. patent application Ser. No. 09/970,840, filed Oct. 5, 2001 ("Co-Pending application 10");

SYSTEM FOR HANDLING FOLDED SHEET MATERIAL, Trovinger, U.S. patent application Ser. No. 10/084,459, filed on even date ("Co-Pending application 11"); and PIVOTABLE COLLECTING DEVICE, Trovinger, U.S. patent application Ser. No. 10/084,462, filed on even date ("Co-Pending application 12").

For example, collecting device 102 can be configured as any of the collecting devices described in Co-Pending applications 1–12; alternatively, collecting device 102 can be arranged as any means for supporting folded sheet material.

Figure 1C:
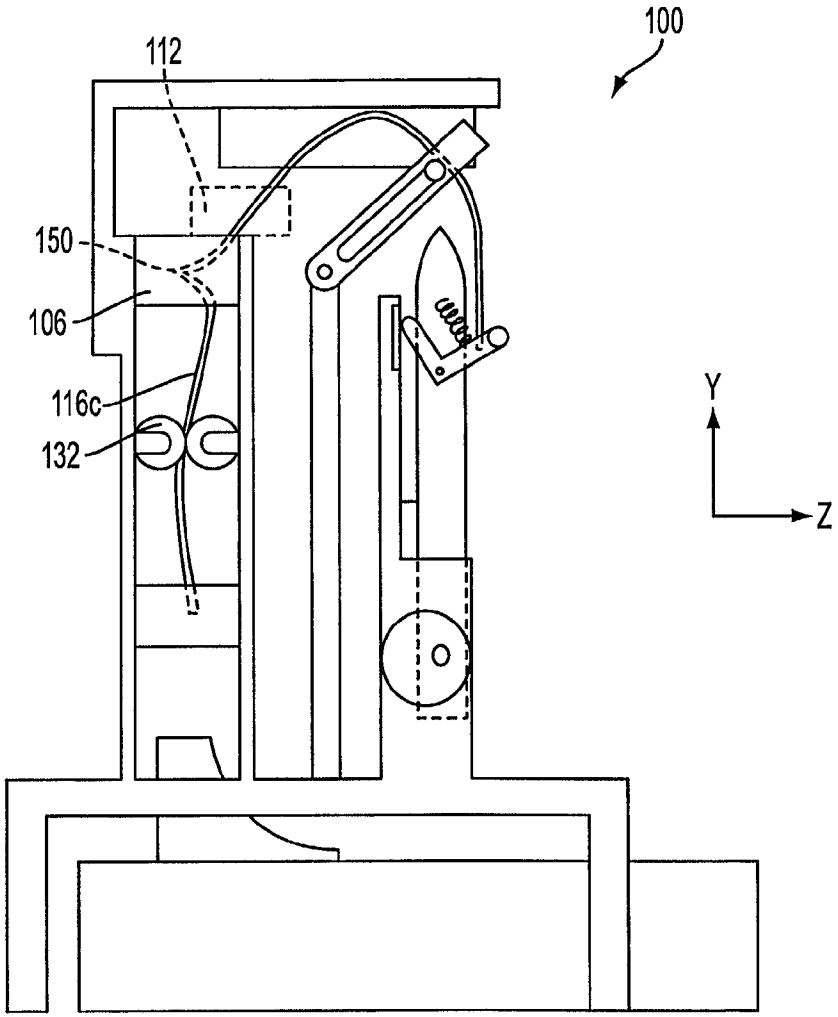
Figure 1D:
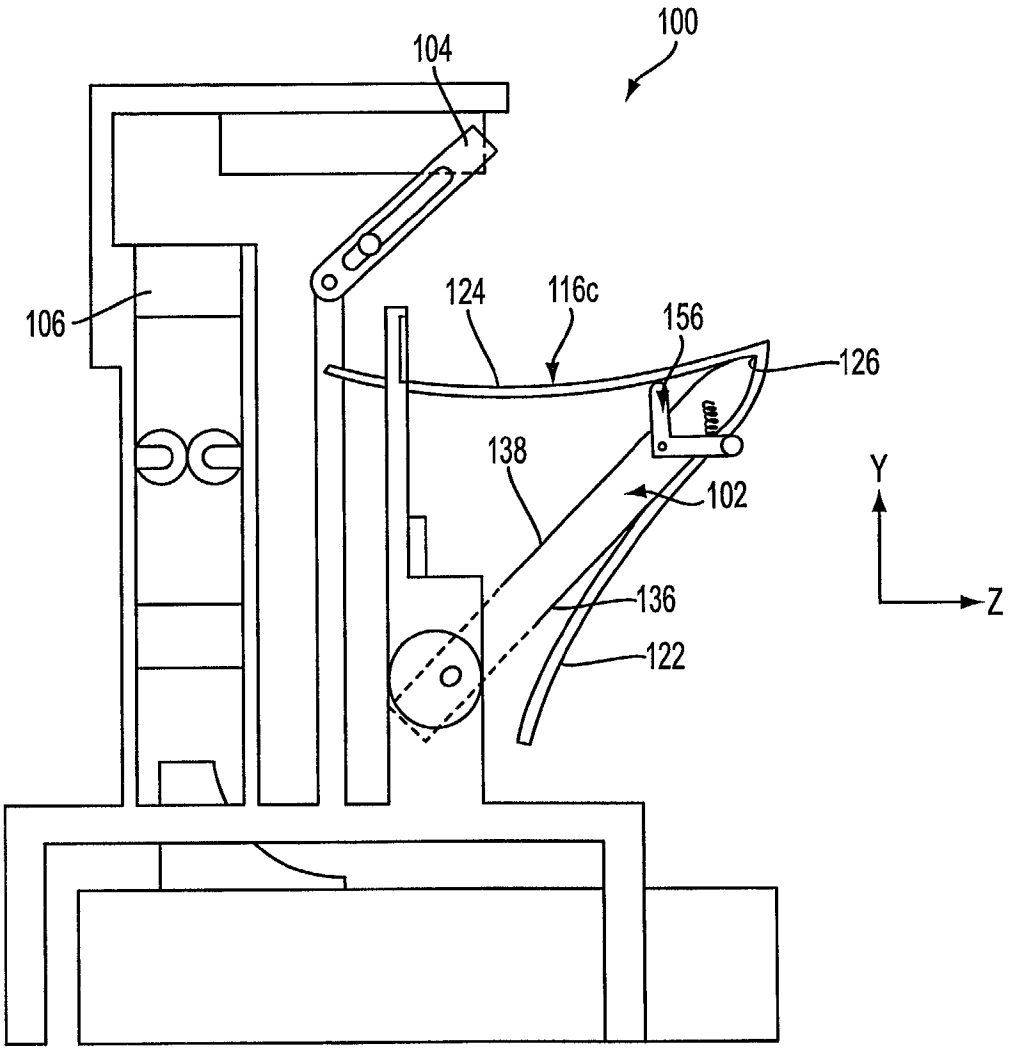
Figure 2:
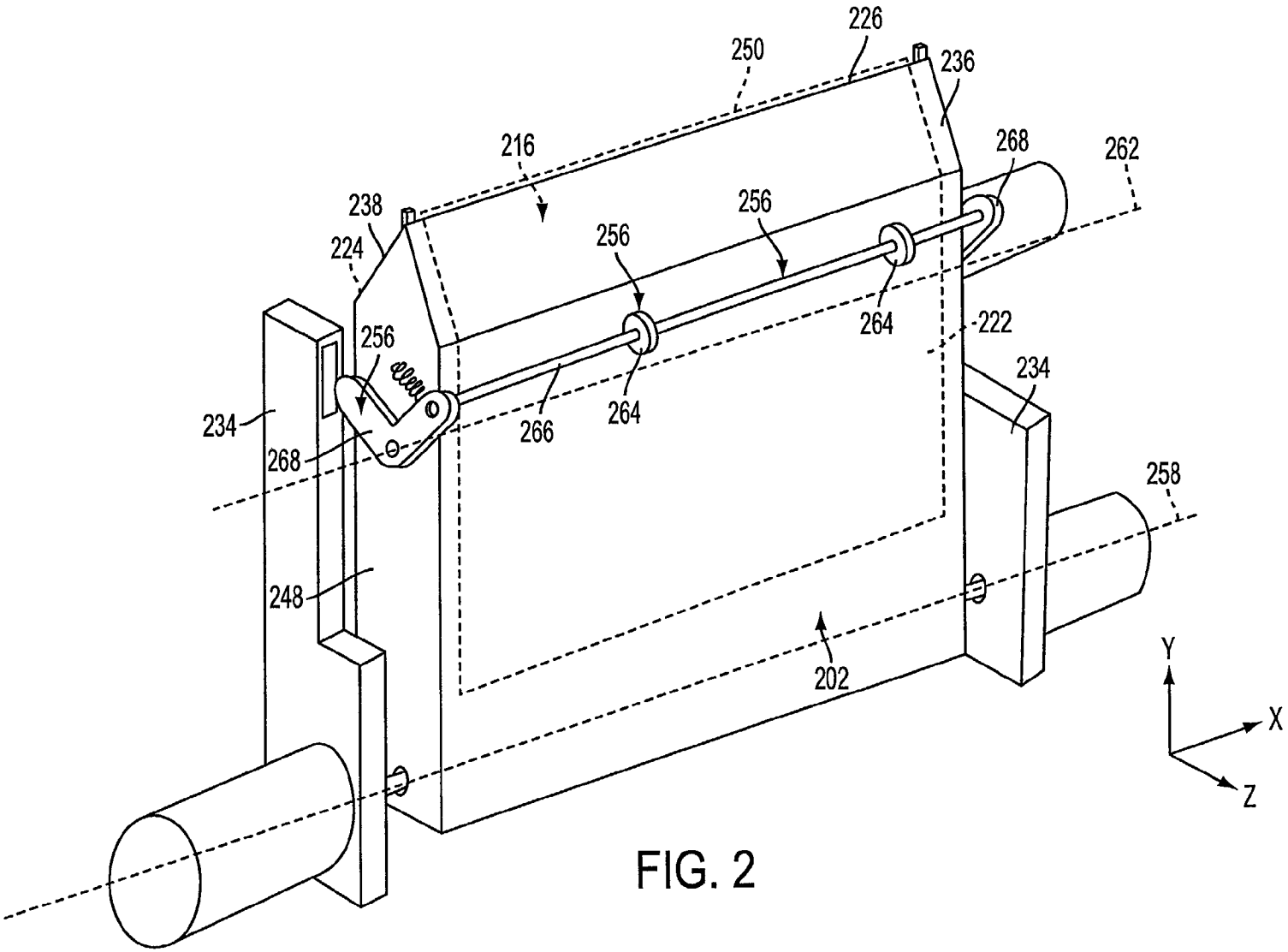
FIG. 2 is a perspective view of a collecting device in accordance with the exemplary embodiment of FIGS. 1A–1D.

In an exemplary embodiment, as shown in exemplary FIG. 2, collecting device 202 (which can correspond to collecting device 102 in FIGS. 1A–1D) pivots about a first axis 258 and is shaped as a saddle (e.g., arranged as an inverted V). Collecting device 202 includes first supporting side 236, second supporting side 238, supporting edge 226, and mounting sides 248. These elements can be made of metal, plastic, or any other materials capable of supporting sheet material. Collecting device 202 is pivotably mounted on a frame 234, which can be of any material and configuration known in the art for supporting processing devices.

Also provided in an exemplary embodiment is a rotatable transferring device (e.g., transferring device 104 in FIGS. 1A–1D) including a displaceable clamping component (e.g., clamping component 118). Transferring device 104 can be configured as any of the transferring devices (also referring to as flippers and clamping devices) described in Co-Pending applications 1–12. Alternatively, transferring device 104 can also be arranged as any means known for transferring sheet material.

Figure 5A:
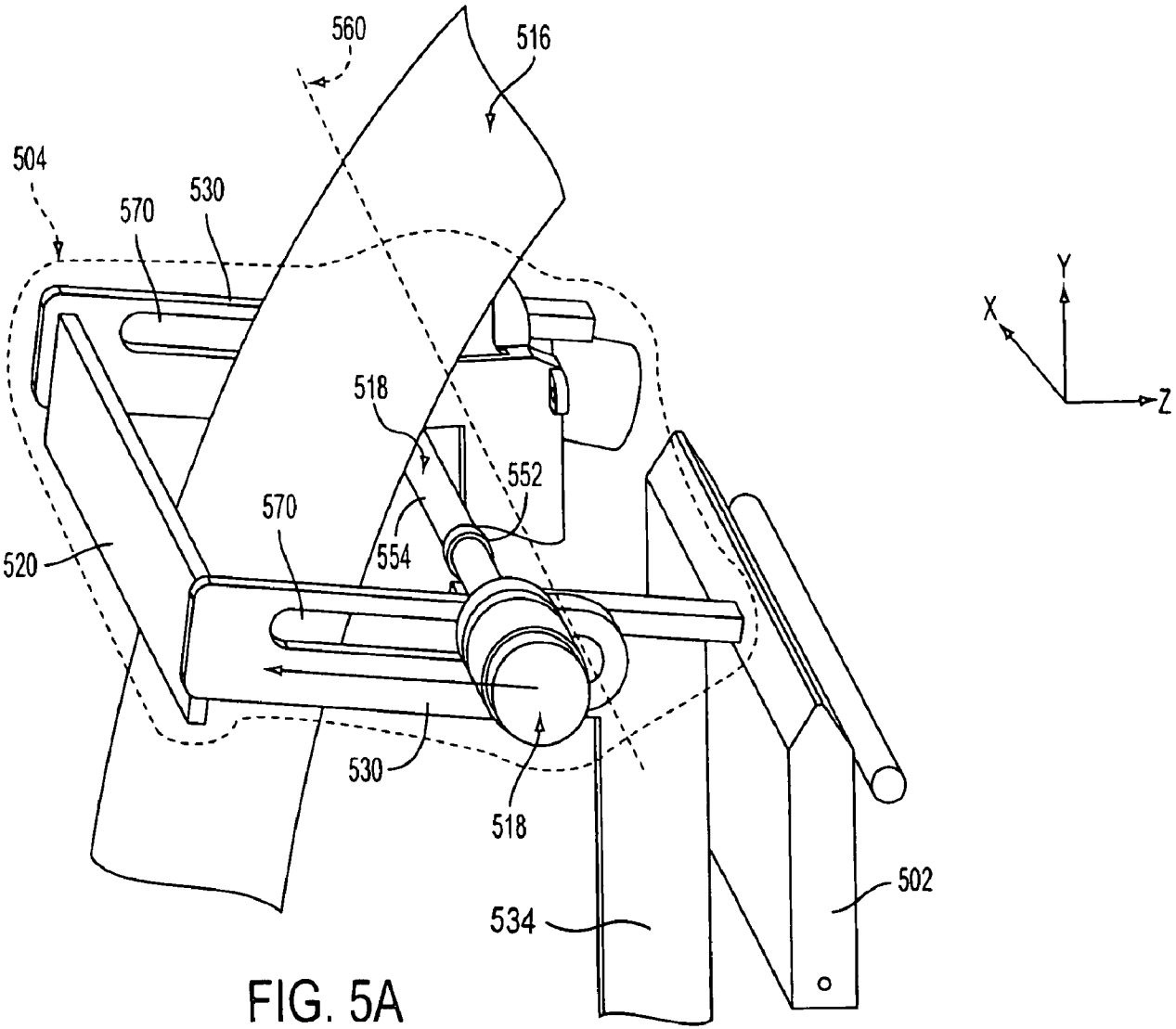
FIGS. 5A–5G are perspective views of a transferring device and collecting device in accordance with the exemplary embodiment of FIGS. 1A–1D.

In the exemplary embodiment of FIG. 5A, transferring device 504 pivots about a second axis 560 and includes a displaceable clamping component 518, a fixed clamping component 520, and a rotatable arm 530. Displaceable clamping component 518 includes drive tires 552, which are mounted on a rotatable drive shaft 554.

In an exemplary embodiment, the transferring device delivers a folded sheet material to the collecting device along a non-linear path, and the collecting device pivots to receive the folded sheet material from the transferring device such that different portions of the folded sheet material are supported by different sides of the supporting sides of the collecting device. For example, with reference to FIGS. 5C–5G, transferring device 504 delivers a folded sheet material 516*c* to collecting device 502 along a rotational path, where collecting device pivots (see FIG. 5F) to receive folded sheet material 516*c* from transferring device 504 such that first and second portions 522 and 524 are supported by first and second supporting sides 536 and 538, respectively. First and second portions 222 and 224 can also be referred to as leading and trailing sides, respectively.

With respect to an exemplary collecting device, supporting sides (e.g., first and second supporting sides 236 and 238) are arranged on opposite sides of the collecting device. For example, with reference to FIG. 2, first and second supporting sides 236 and 238 are positioned on opposite sides of collecting device 202 (which can correspond to collecting device 102 in FIG. 1A) and are substantially parallel to one another. Alternatively, first and second supporting sides 236 and 238 can be arranged such that an obtuse or acute angle exists between them, and such an arrangement would remain within the definition of the term "opposing" in the context of the present invention.

Also, the supporting sides (e.g., first and second supporting sides 236 and 238) converge at a supporting edge (e.g., supporting edge 226). As shown in exemplary FIG. 2, supporting sides 236 and 238 are substantially parallel to one another, but each have an area that curves (sharply or gradually) toward the other supporting sides such that a supporting edge 226 is formed. Supporting edge 226 supports a fold of a folded sheet material, such as fold 250 and can be formed as a sharp blade, can include some curvature (e.g., be rounded in shape), or can include sharp corners A collecting drive (e.g., collecting drive 156) is provided in an exemplary embodiment for clamping a portion of the folded sheet material (e.g., first portion 122 shown in FIG. 1D) against a supporting side (e.g., first supporting side 136) and for advancing the portion along the supporting side. The exemplary collecting drive can be arranged as described in Co-Pending application 12, or can alternatively be configured in any manner which can achieve the functionality as described herein. In the exemplary embodiment of FIG. 2, collecting drive 256 pivots about a third axis 262. Collecting drive 256 can be rotatably mounted on mounting sides 248, or can be alternatively mounted on another portion of pivotable collecting device 202. Included in collecting drive 256 are tires 264, a rotatable shaft 266, and arms 268.

Also, the exemplary transferring device includes a rotatable arm (e.g., arm 530 in FIG. 5A) and a fixed clamping component (e.g., clamping component 520), where the folded sheet material is delivered to the collecting device by clamping a portion of the folded sheet material between the displaceable and fixed clamping components and by rotating the rotatable arm. As shown in the FIG. 5A example, fixed clamping component 520 is fixedly mounted at one end of each arm 530, while the other end is pivotably attached to frame 534. During an operation where sheet material is to be clamped within transferring device 504, clamping component 518 is moved towards clamping component 520 along guide slots 570 until sheet material 516 is secured between clamping components 518 and 520. Arm 530 can then be rotated to deliver sheet material 516 along a rotational path (i.e., an arc established by movement of arm 530). Also, once sheet material 516 is so clamped, clamping component 520 can rotate to drive sheet material 516 along clamping component 520. In this way, transferring device 504 can be used to both secure, rotate, and drive sheet material 516.

In an exemplary embodiment, the transferring device (e.g., transferring device 504) is configured to simultaneously secure different portions of the folded sheet material against different supporting sides. For example, as illustrated in exemplary FIG. 5G, clamping components 518 and 520 are positioned such that they exert force against opposing sides of a collecting device at the same time. That is, transferring device 504 is shown to be arranged such that clamping components 518 and 520 are positioned on (and are able to press against) different and opposing sides of collecting device 502 at the same time. In this way, folded sheet material 516*c* can be secured against opposing supporting sides 536 and 538 of collecting device 502 with the use of transferring device 504.

Figure 3:
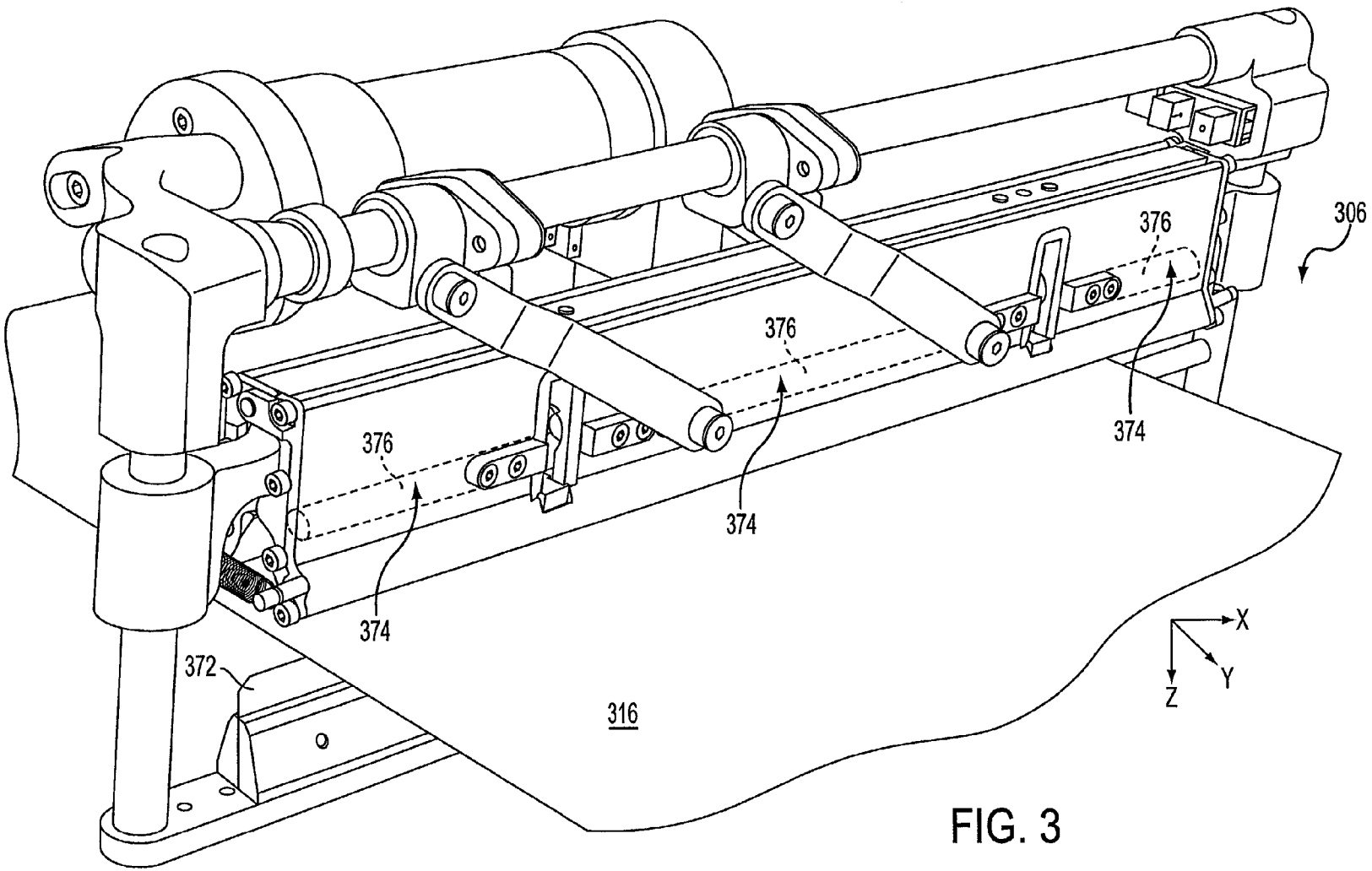
FIG. 3 is a perspective view of a folding device in accordance with the exemplary embodiment of FIGS. 1A–1D.

A folding device (e.g., folding device 106 in FIG. 1A) is provided in an exemplary embodiment for establishing a fold in a trimmed sheet (e.g., trimmed sheet material 116*b* in FIG. 1B) to create the folded sheet material (e.g., folded sheet material 116*c* in FIGS. 1C–1D). In the context of the present invention, the term "trimmed sheet" refers to sheet material that has not yet been folded. Folding device 106 can be configured as any of the folding devices described in Co-Pending applications 1–12, or can alternatively be arranged as any other folding device which can achieve the functionality described herein. In the exemplary embodiment shown in FIG. 3, folding device 306 includes a fold blade 372 having a longitudinal axis along the x-axis of FIG. 3. Folding device 306 also includes fold rollers 374, each of which rotates about an axis parallel to a longitudinal axis of fold blade 372. Further, each fold roller 374 includes multiple sub-rollers 376, wherein a cumulative length of the sub-rollers and spaces between the sub-rollers is at least the length of a desired fold.

The exemplary booklet maker is also provided with a cutting device (e.g., cutting device 108) for cutting an original sheet to create the trimmed sheet. In the context of the present invention, the term "original sheet" refers to sheet material that has not yet been cut. Cutting device 108 can be configured as any of the cutting devices (also referred to trimming devices) described in Co-Pending applications 1–12, or can alternatively be arranged as any cutting device.

Also provided is an input feed device (e.g., input feed device 110) for delivering an original sheet (e.g., sheet material 116*a*) to the cutting device from an input tray (e.g., tray 178). Input feed device 110 can be configured as any of the input feed devices (also referred to as pick devices) described in Co-Pending applications 1–12, or can alternatively be arranged as any feeding device. Sheet material to be formed into booklet sheets originates from tray 178, which can be arranged as any means for containing or supporting sheet material, and can be detachable from the other components of booklet maker 100 (e.g., housing 144, shown in FIG. 1A). Original sheet material 116*a* can be arranged in tray 178 as multiple, discrete sheets or as a continuous strip of material. Also, sheet material 116*a* can be of any material, thickness, and width.

In an exemplary embodiment, the input tray (e.g., tray 178) is formed as, or is connected to, an output tray of a printing device (e.g., printing device 140). In this manner, booklet maker 100 can be detachably connected via tray 178 to a separate printing device 140, which can be any printing apparatus (e.g., a desktop printer unit). Booklet maker 100 can, of course, also exist as a stand alone device.

The exemplary booklet maker can also include a hole punching device (e.g., hole punching device 112 in FIG. 1C) for creating a hole in the folded sheet material. Hole punching device 112 can be configured as the hole punching device described in Co-Pending application 2, or can alternatively be arranged as any means for creating holes known in the art.

Figure 4:
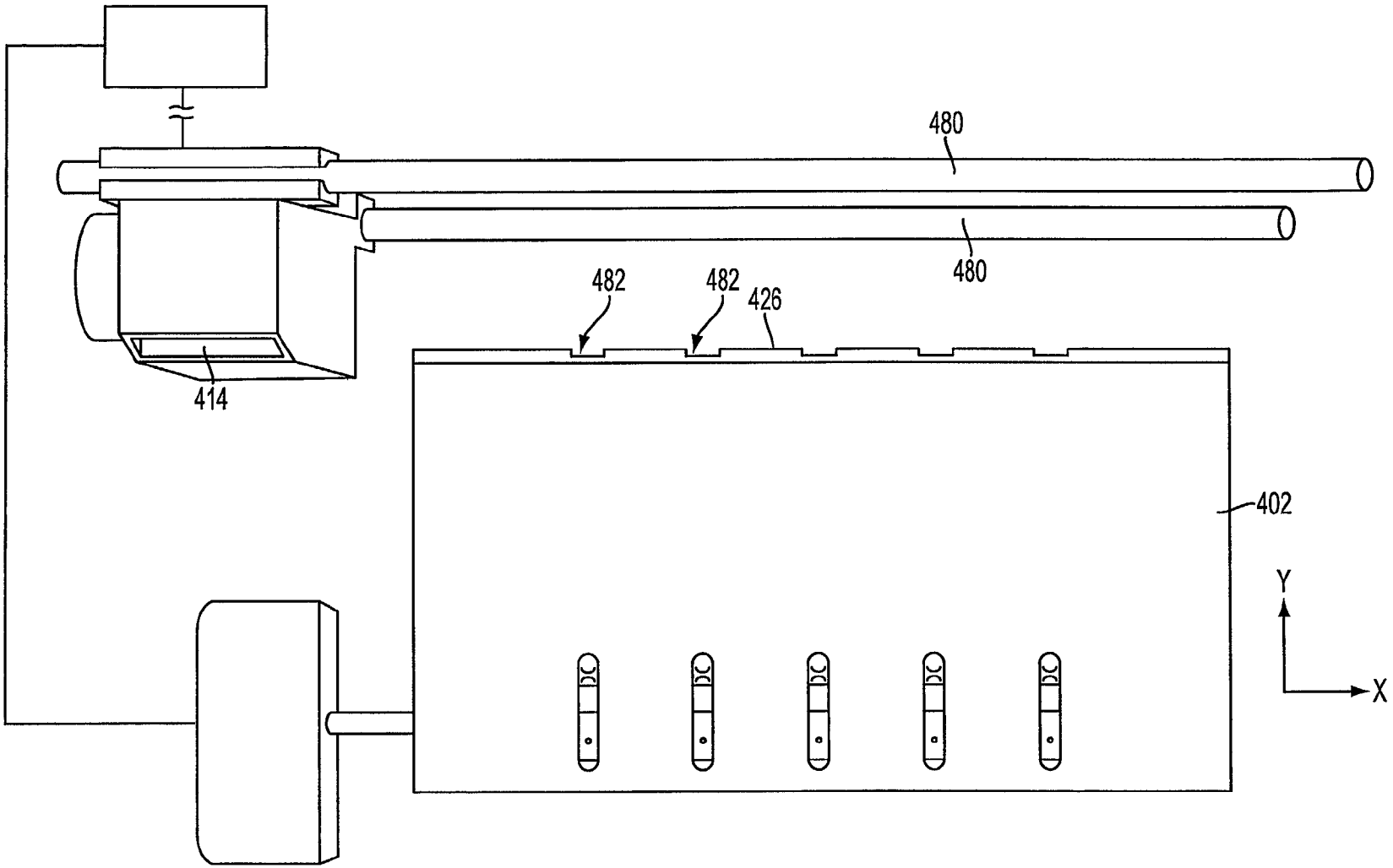
FIG. 4 is a frontal view of a stapling device and a collecting device in accordance with the exemplary embodiment of FIGS. 1A–1D.
Figure 6B:
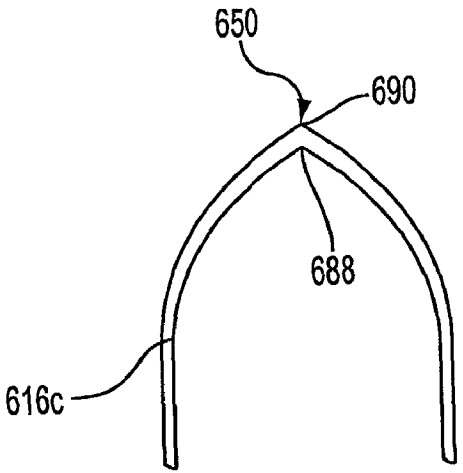
FIGS. 6A and 6B are a side views of a stack of folded sheet material in accordance with the exemplary embodiment of FIGS. 1A–1D.

Also provided is a stapling device (e.g., stapling device 114) for stapling the folded sheet material after the folded sheet material is received by the collecting device. Stapling device 114 can be configured as any of the stapling devices described in Co-Pending applications 1–12, or can alternatively be arranged as any means for binding known in the art. In an exemplary embodiment, stapling device 414 (FIG. 4) is movable along supporting edge 426 of collecting device 402 for stapling a stack of folded sheet material (e.g., stack 686 in FIG. 6) at multiple clinch locations 482. Stapling device 414 can be translatably mounted on two rails 480 for movement along supporting edge 426.

The exemplary booklet maker also includes a processing unit (e.g., processing unit 142) for storing and/or generating individual sheet information, wherein the processing unit controls the cutting device to cut the original sheet material (e.g., original sheet material 116*a*) based on the individual sheet information. Processing unit 142 can be arranged as any computing and controlling apparatus known in the art, and can include such components as a microprocessor and a memory. Also, processing unit 142 can be connected to any component of booklet maker 100 (e.g., input feed device 110, cutting device 108, etc.) by any data or power transferring means known in the art. As described in detail in Co-Pending applications 1–12, individual booklet sheets are processed based on desired characteristics for each particular sheet. This information (e.g., desired dimensions of each sheet) is represented by individual sheet information, which can take form as digital data generated or received by processing unit 142. Based on individual sheet information, devices in booklet maker 100 (e.g., input feed device 110, cutting device 108, etc.) are controlled to produce individual sheets (and, ultimately, a booklet) of desired dimensions.

For example, with respect to cutting device 108, each original sheet 116*a* can be trimmed to a unique and precise length so that the edge of an assembled booklet is flat, as if all the sheets had been trimmed together in a final trimming operation. The dimension that each booklet is trimmed to can be determined by an algorithm and can be a function of the page number and the thickness of the paper. The algorithm can be performed by processing unit 142 or by a unit remote from booklet maker 100 (e.g., a personal computer unit).

A method of making booklets is represented in FIGS. 1A–1D and 5A–5G. The exemplary method can include any of the sheet handling steps described in any of Co-Pending applications 1–12. As shown in FIGS. 5A–5G, transferring device 504 receives sheet material 516 while in a load position, delivers folded sheet material 516*c* to collecting device 502 while in an unload position, and secures folded sheet material 516*c* against collecting device 502 while in a clamping position.

Figure 5B:
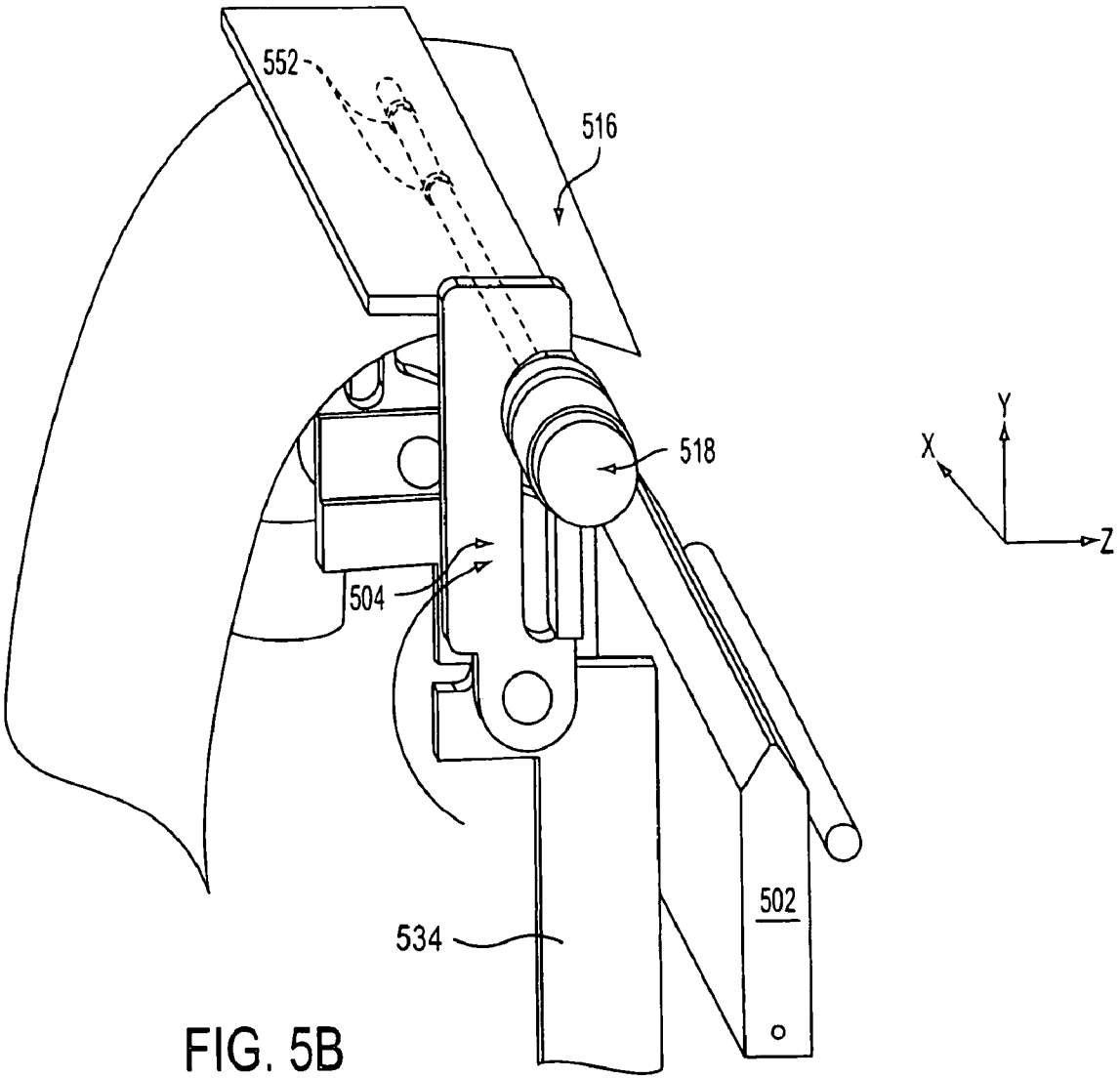

In an exemplary embodiment, a step of clamping a folded sheet material (e.g., sheet material 516*c*) with a rotatable transferring device (e.g., transferring device 504) is provided. FIG. 5A illustrates transferring device 504 in a loading or first position, where sheet material 516 is advanced by an upstream device, such as a main drive, into rotatable clamping device 504. At this point, sheet material 516 can be in an original, trimmed, or folded state. In FIG. 5B, displaceable clamping component 518 is moved against fixed clamping component 520, thereby achieving a closed position and clamping a portion of sheet material 516 against fixed clamping component 520.

Figure 5C:
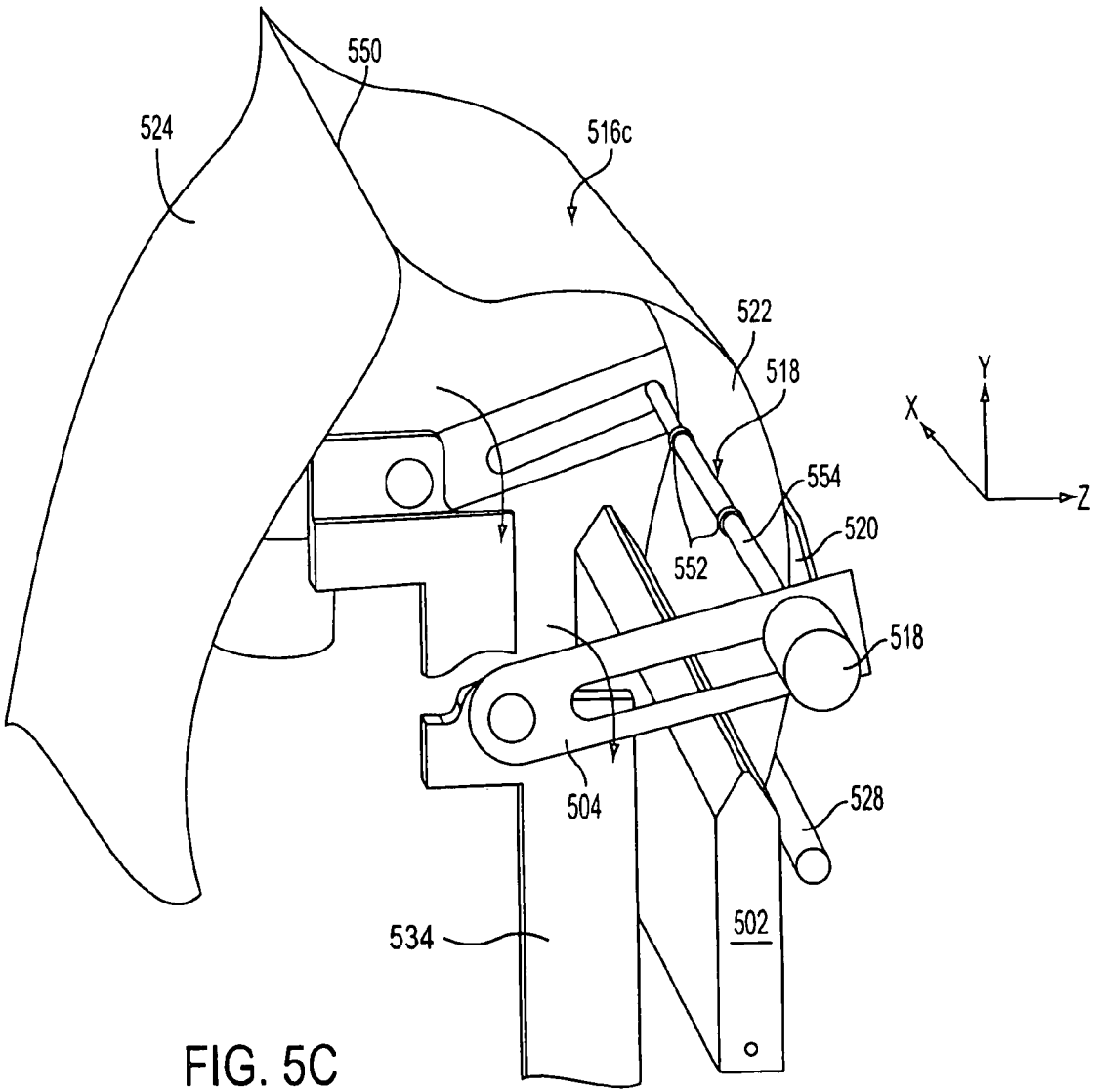

A step is provided in an exemplary embodiment to deliver the folded sheet material (e.g., folded sheet material 516*c*) to a pivotable collecting device along an arc established by movement of the rotatable clamping device (e.g., transferring device 504 in FIGS. 5B and 5C). As shown in the FIG. 5B example, transferring device 504 is rotated towards collecting device 502, stopping at an intermediate position while sheet material 516 remains clamped. At this point, sheet material 516 can be folded (to create folded sheet material 516*c*). As shown in the FIG. 5C example, transferring device 504 is then rotated from the intermediate position shown in FIG. 5B towards collecting device 502 such that first portion 522 of the clamped and folded sheet material 516*c* is delivered between collecting device 502 and collecting drive 528. Alternatively, while transferring device 504 is positioned in the intermediate position, displaceable clamping component 518 can be rotated such that first portion 522 of sheet material 516*c* is advanced toward collecting device 502 and such that first portion 522 passes between collecting device 502 and collecting drive 528 (which is positioned away from collecting device 502). Further, folded sheet material 516*c* can be delivered to collecting device 502 by any other manner using transferring device 504.

Figure 5D:
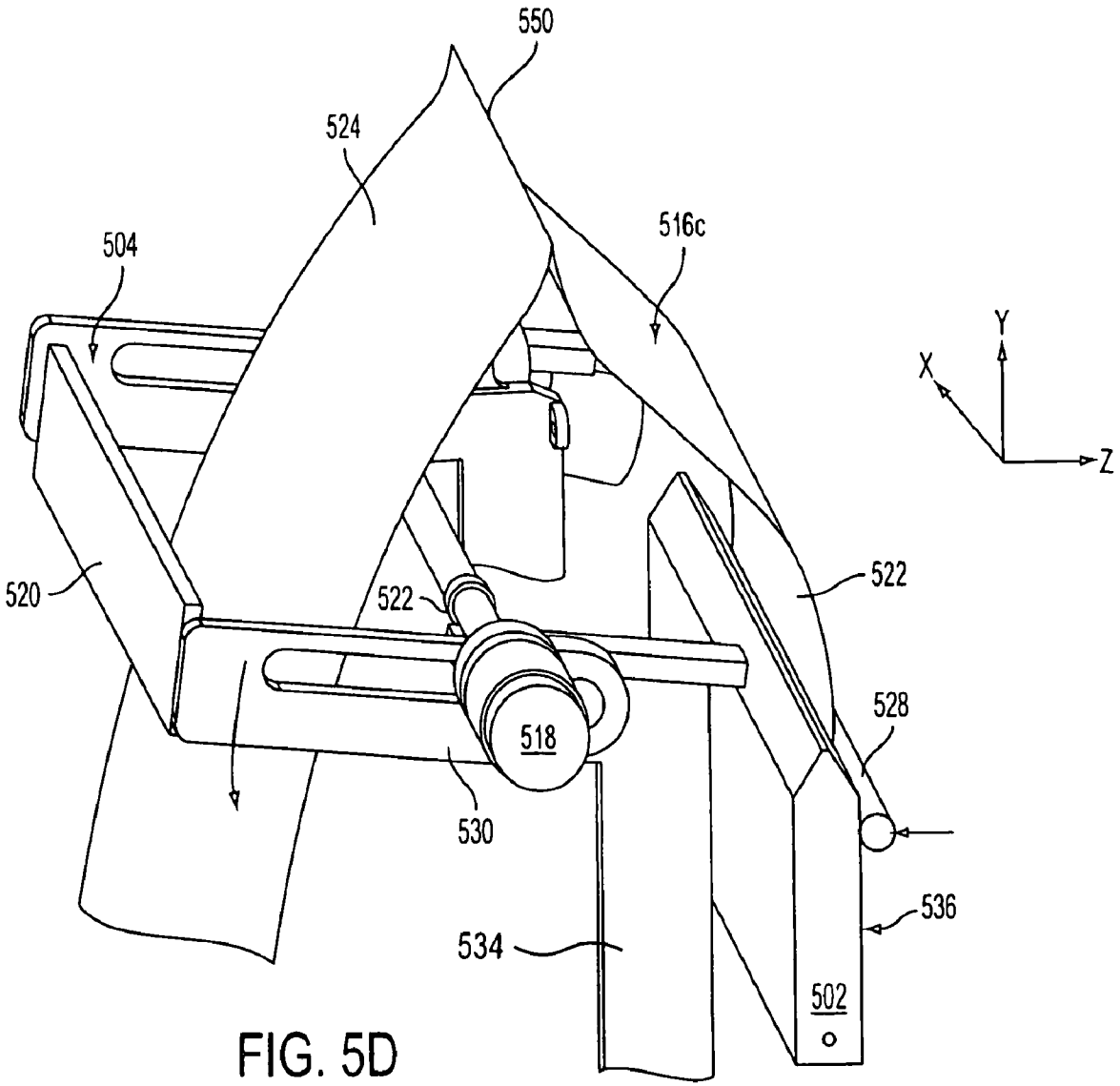
Figure 5E:
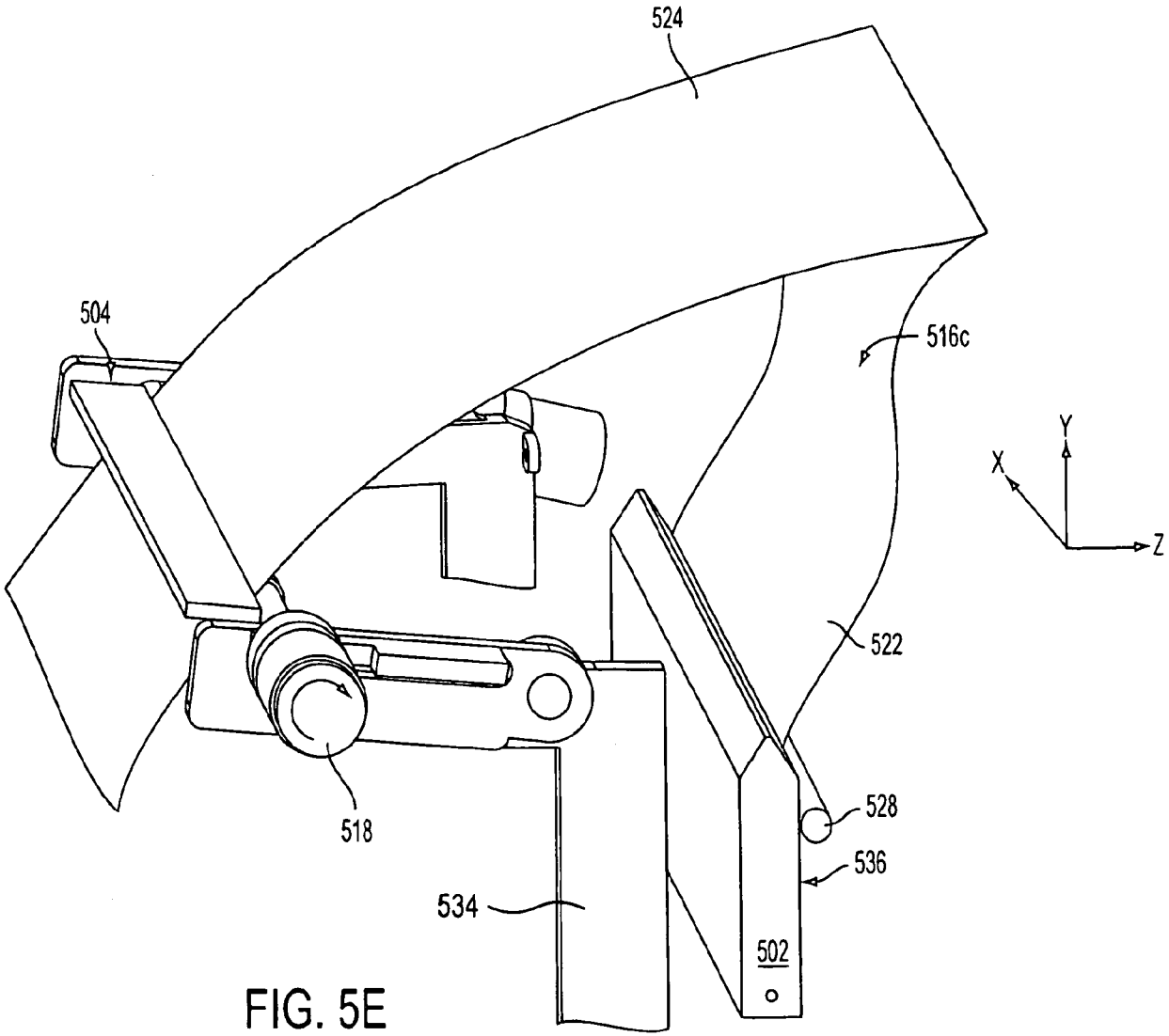
Figure 5F:
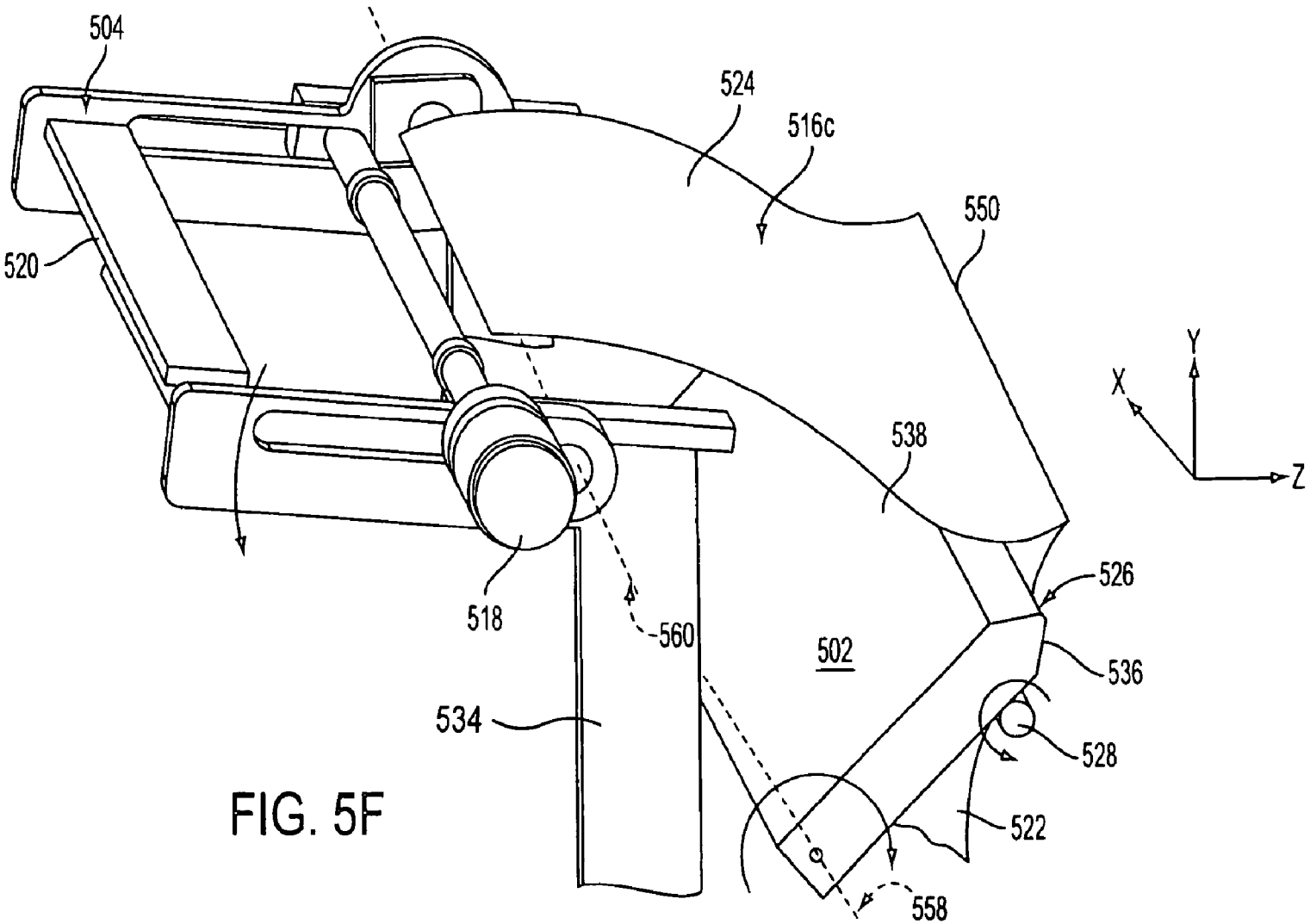
Figure 5G:
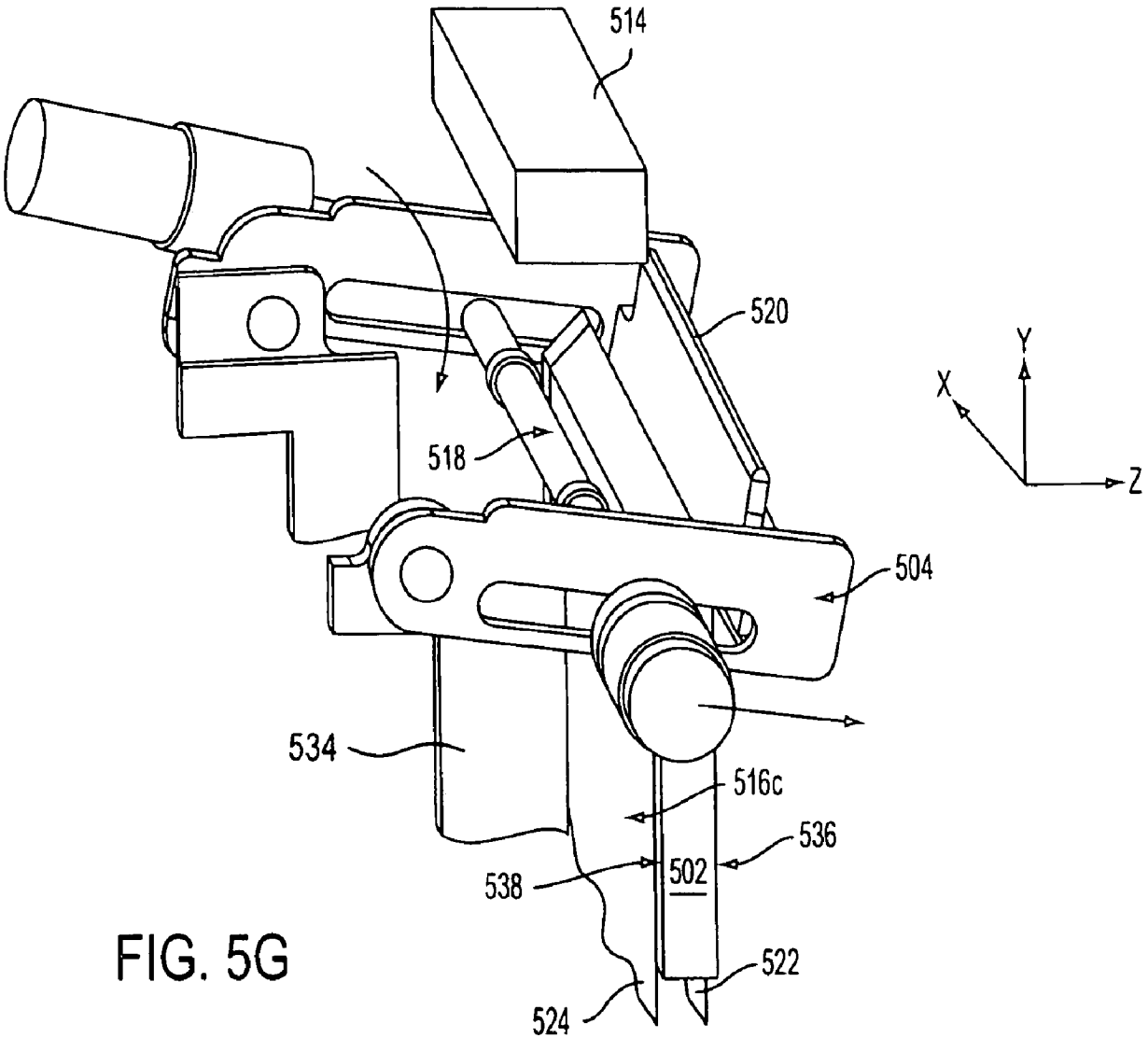
Figure 6A:
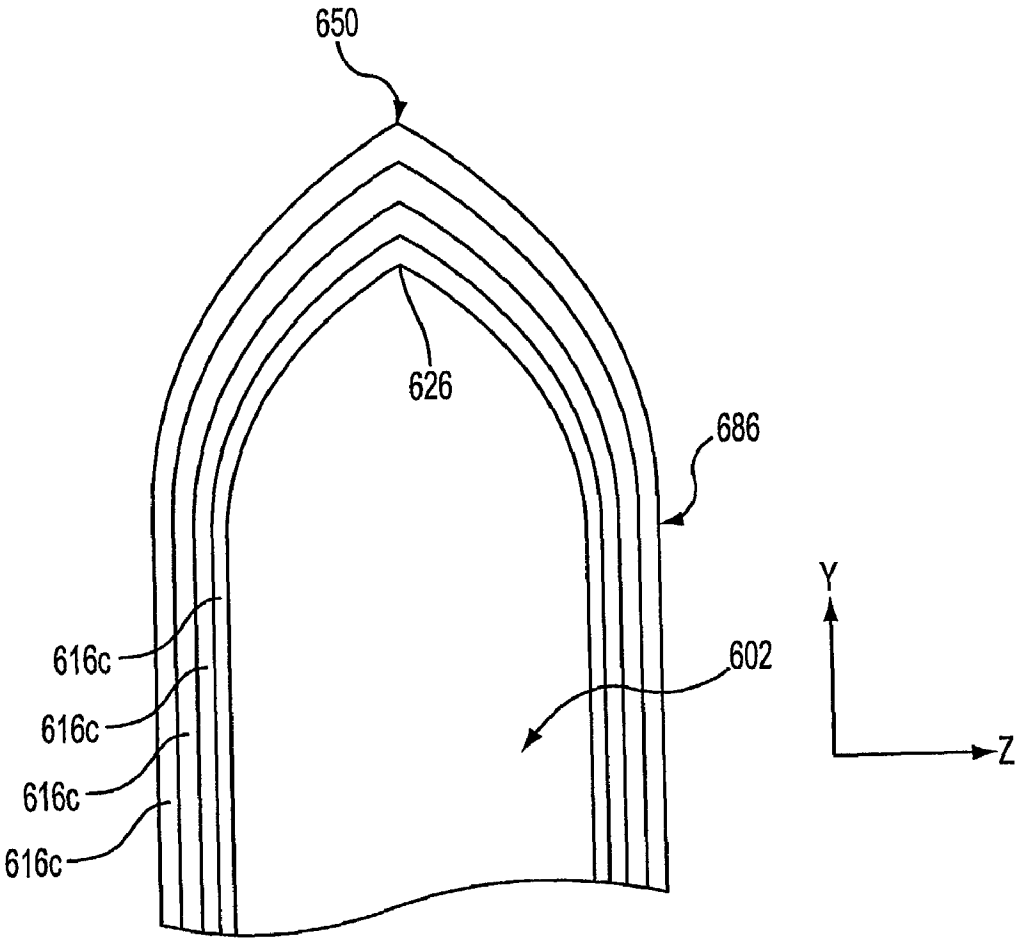

In an exemplary embodiment, the folded sheet material is deposited over a supporting edge (e.g., supporting edge 526) of the collecting device such that a fold (e.g., fold 550) of the folded sheet material is received by the supporting edge (e.g., as shown in FIGS. 5F, 5G, and 6). As shown in FIG. 5D, collecting drive 528 is operated to secure first portion 522 against first supporting side 536. Then, clamping component 518 is moved away from clamping component 520, thereby releasing sheet material 516*c* (which is now secured to collecting device 502 by collecting drive 528). Transferring device 504 then rotates away from collecting device 502 and over fold 550 such that fixed clamping component 520 is positioned over second portion 524. Transferring device then clamps and begins to advance second portion 524 towards collecting device 502, as shown in FIG. 5E, while collecting drive 528 secures first portion 522 to first supporting side 536. As shown in FIG. 5F, collecting drive 528 rotates to advance first portion 522 down first supporting side 536 such that fold 550 approaches, and is eventually supported by, supporting edge 526.

Provided in an exemplary embodiment is a step of pivoting the collecting device (e.g., collecting device 502) such that different portions of the folded sheet material (e.g., first and second portion 522 and 524) are received by different supporting sides of the collecting device (e.g., first and second supporting sides 536 and 538). As collecting drive 528 advances fold 550 towards supporting edge 526 (FIG. 5F), collecting device 520 rotates about first axis 558 such that supporting edge 526 moves away from second axis 560. At the same time, transferring device 504 releases second portion 524. This movement allows second portion 524 to clear transferring device 504 (i.e., to exit the space between clamping components 518 and 520) and to fall against second supporting side 538, thus completing the hand-off (this is also illustrated in FIG. 1D). Transferring device 504 can also be rotated to sweep second portion 524 against second supporting side 538.

Thus, in an exemplary embodiment, the collecting device (e.g., collecting device 502) pivots to receive the folded sheet material such that: a first portion of the folded sheet material is received on a first supporting side of the collecting device (e.g., first portion 522 is received on first supporting side 536), and a second portion of the folded sheet material is received on a second supporting side of the collecting device (e.g., second portion 524 is received on second supporting side 538).

An exemplary embodiment includes a step of folding a trimmed sheet (e.g., sheet material 116*b* in FIG. 1B) to form a folded sheet material (e.g., sheet material 116*c* in FIGS. 1C and 1D). For example, at the position shown in FIG. 1C (which can correspond to FIG. 5B), a fold 150 is formed by folding device 106 to create folded sheet material 116*c*. Trimmed sheet 116*b* can be forwarded from cutting device 108 to folding device 106 by, for example, a driving device 132, which can be any means for driving sheet material.

A step of cutting an original sheet (e.g. sheet material 116*a*) to create a trimmed sheet (e.g., sheet material 116*b* in FIG. 1B) is provided in an exemplary embodiment. For example, in FIG. 1B, sheet material 116*b* is created by trimming a portion 184 from sheet material 116*a* with cutting device 108. The dimensions of trimmed portion 184 can be different for each sheet and can be based on individual sheet information. Also, a step of de-skewing can be performed, where an original sheet 116*a* is aligned by any means for aligning sheet material before being processed by cutting device 108.

To form a complete booklet, also provided in an exemplary embodiment is a step of transferring additional folded sheet materials individually to the collecting device along the established arc. For examples, the steps described above (and illustrated by FIGS. 1A–1D and 5A–5F) can be repeated until a desired quantity of folded booklet sheets is transferred to collecting device 102, where each booklet sheet can be process based on individual sheet information such that a completed booklet exhibits desirable characteristics (e.g., a flush edge).

A step is provided in an exemplary embodiment for pivoting the collecting device to receive each folded sheet material (e.g., as shown in FIGS. 1D and 5F) such that a stack of folded sheet materials (e.g., stack 686 in FIG. 6) is formed on the collecting device.

In an exemplary embodiment, an inner fold edge of each additional folded sheet material (e.g., inner fold edge 688 in FIG. 6B) is received by an outer fold edge (e.g., outer fold edge 690) of a previously received folded sheet material. For example, in exemplary FIG. 6B (which illustrates fold 650 of one folded sheet material 616*c* from stack 686), fold 650 of each folded sheet material 616*c* includes an inner fold edge 688 and an outer fold edge 690. The sheet material 616*c* directly supported by supporting edge 626 has its inner fold edge 688 supported by supporting edge 626, while its outer fold edge 690 supports the inner fold edge of an additional sheet material 616*c*. In this way, the folds 650 are aligned, and the stack 686 assumes the form of a booklet supported by supporting edge 626.

A step of stapling the stack of folded sheet material (e.g., stack 686) is also provided in an exemplary embodiment. For example, stack 686 can be stapled in multiple locations along the longitudinal axis of supporting edge 626 (e.g., along the x-axis in FIG. 4) by stapling device 114. After stack 686 is stapled, the assembled booklet can be ejected onto an output tray (e.g., output tray 146 in FIG. 1A).

It will be appreciated by those skilled in the art that the present invention can be embodied in other specific forms without departing from the spirit or essential characteristics thereof. The presently disclosed embodiments are therefore considered in all respects illustrative and not restricted. The scope of the invention is indicated by the appended claims rather than the foregoing description and all changes that come within the meaning and range and equivalence thereof are intended to be embraced within.

What is claimed is:

1. A booklet maker, comprising:

a reciprocating pivotable collecting device including two supporting sides formed with a saddle shape at a first edge and a connector between the two supporting sides at a second edge to enclose a volume; and a reciprocating transferring device including a displaceable clamping component, wherein the transferring device reciprocates along a non-linear path to deliver a folded sheet material to the collecting device, and the collecting device pivots to receive the folded sheet material from the transferring device such that different portions of the folded sheet material are supported by different sides of the two supporting sides of the collecting device, wherein the supporting sides are arranged on opposite sides of the collecting device and wherein the reciprocating pivotable collecting device reciprocatingly pivots about an axis positioned between the two supporting sides and passing through the volume.

2. The booklet maker of claim 1, wherein the supporting sides converge at a supporting edge.

3. The booklet maker of claim 1, wherein the transferring device is configured to simultaneously secure different portions of the folded sheet material against different supporting sides.

4. The booklet maker of claim 1, comprising:

a folding device for establishing a fold in a trimmed sheet material to create the folded sheet material.

5. The booklet maker of claim 1, comprising:

a hole punching device for creating a hole in the folded sheet material.

6. The booklet maker of claim 1, comprising:

a stapling device for stapling the folded sheet material after the folded sheet material is received by the collecting device.

7. The booklet maker of claim 4, comprising:

a cutting device for cutting an original sheet material to create the trimmed sheet.

8. The booklet maker of claim 7, comprising:

an input feed device for delivering an original sheet material to the cutting device from an input tray.

9. The booklet maker of claim 7, comprising:

a processing unit for at least one of storing and generating individual sheet information, wherein the processing unit controls the cutting device to cut the original sheet material based on the individual sheet information.

10. The booklet maker of claim 8, wherein the input tray is at least one of formed as and connected to an output tray of a printing device.

11. A booklet maker, comprising:

a pivotable collecting device including two supporting sides formed with a saddle shape;

a reciprocating transferring device including a displaceable clamping component, wherein the transferring device reciprocates along a non-linear path to deliver a folded sheet material to the collecting device, and the collecting device pivots to receive the folded sheet material from the transferring device such that different portions of the folded sheet material are supported by different sides of the two supporting sides of the collecting device; and a collecting drive for clamping a portion of the folded sheet material against a supporting side and for advancing the portion along the supporting side.

12. The booklet maker of claim 11, wherein the collecting drive moves from a first disengaged position to a second engaged position during the pivoting of the collecting device, and wherein an advancing element is spaced apart from a first side of the collecting device in the disengaged position and the advancing element applies pressure to the first side of the collecting device in the engaged position.

13. The booklet maker of claim 12, wherein the advancing element is a tire mounted on a rotatable shaft.

14. A booklet maker, comprising:

a pivotable collecting device including two supporting sides formed with a saddle shape; and a reciprocating transferring device including a displaceable clamping component, wherein the transferring device reciprocates along a non-linear path to deliver a folded sheet material to the collecting device, and the collecting device pivots to receive the folded sheet material from the transferring device such that different portions of the folded sheet material are supported by different sides of the two supporting sides of the collecting device, wherein the transferring device comprises:

an arm; and a fixed clamping component, wherein the folded sheet material is delivered to the collecting device by clamping a portion of the folded sheet material between the displaceable and fixed clamping components and by moving the arm along the non-linear path.

15. The booklet maker of claim 14, wherein the transferring device at completion of movement in a first direction along the non-linear path places the fixed clamping component of the transferring device on a first supporting side of the collecting device and the displaceable clamping component of the transferring device on a second supporting side of the collecting device to clamp the sheet on the collecting device.

16. The booklet maker of claim 15, wherein the displaceable clamping component displaces along an axis of the arm from a disengaged position to an engaged position to clamp the sheet on the collecting device.

17. A method of making booklets, comprising the steps of:

clamping a folded sheet material with a reciprocating transferring device;

delivering the folded sheet material to a reciprocating pivotable collecting device along an arc established by movement of the transferring device, the folded sheet material being deposited over a supporting edge of the collecting device such that a fold of the folded sheet material is received by the supporting edge; and pivoting the collecting device about an axis positioned between two supporting sides of the collecting device and passing through a volume of the collecting device such that different portions of the folded sheet material are received by different supporting sides of the collecting device, the volume of the collecting device enclosed by at least the two supporting sides, the supporting edge and a bottom connector between the two supporting sides.

18. The method of claim 17, wherein the collecting device pivots to receive the folded sheet material such that: a first portion of the folded sheet material is received on a first supporting side of the collecting device, and a second portion of the folded sheet material is received on a second supporting side of the collecting device.

19. The method of claim 17, comprising the step of:

folding a trimmed sheet material to form a folded sheet material.

20. The method of claim 17, comprising the steps of:

transferring additional folded sheet materials individually to the collecting device along the established arc; and pivoting the collecting device to receive each folded sheet material such that a stack of folded sheet materials is formed on the collecting device.

21. The method of claim 19, comprising the step of:

cutting an original sheet material to create a trimmed sheet.

22. The method of claim 20, wherein an inner fold edge of each additional folded sheet material is received by an outer fold edge of a previously received folded sheet material.

23. The method of claim 20, comprising the step of:

stapling the stack of folded sheet material.

24. A system for making booklets, comprising:

a folding device;

a pivotable collecting device, the collecting device being saddle-shaped with two opposing sides;

a rotatable transferring device including a displaceable clamping component, wherein the transferring device delivers a folded sheet material to the collecting device along a non-linear path, and the collecting device pivots about an axis positioned between two supporting sides of the collecting device to receive the folded sheet material from the transferring device such that different portions of the folded sheet material are supported by opposing sides of the collecting device; and a collecting drive for clamping a portion of the folded sheet material against the collecting device and for advancing the portion along a side of the collecting devices, wherein the transferring device at completion of movement in a first direction along the non-linear oath places a first clamping component of the transferring device on a first supporting side of the collecting device and a second clamping component of the transferring device on a second supporting side of the collecting device to clamp the sheet on the collecting device, and wherein the first clamping component is fixed and the second clamping component is displaceable along an axis of the transferring device from a disengaged position to an engaged position to clamp the sheet on the collecting device.

25. A system for making booklets, comprising:

a folding device;

a pivotable collecting device, the collecting device being saddle-shaped;

a rotatable transferring device including a displaceable clamping component, wherein the transferring device delivers a folded sheet material to the collecting device along a non-linear path, and the collecting device pivots to receive the folded sheet material from the transferring device such that different portions of the folded sheet material are supported by opposing sides of the collecting device; and a collecting drive for clamping a portion of the folded sheet material against the collecting device and for advancing the portion along a side of the collecting device, wherein the transferring device comprises:

a rotatable arm; and a fixed clamping component, wherein the folded sheet material is delivered to the collecting device by clamping a portion of the folded sheet material and by rotating the rotatable arm.

26. A system for making booklets, comprising:

a folding device;

a pivotable collecting device, the collecting device being saddle-shaped;

a rotatable transferring device including a displaceable clamping component, wherein the transferring device delivers a folded sheet material to the collecting device along a non-linear path, and the collecting device pivots to receive the folded sheet material from the transferring device such that different portions of the folded sheet material are supported by opposing sides of the collecting device; and a collecting drive for clamping a portion of the folded sheet material against the collecting device and for advancing the portion along a side of the collecting device, wherein the collecting drive moves from a first disengaged position to a second engaged position during the pivoting of the collecting device, and wherein an advancing element is spaced apart from a first side of the collecting device in the disengaged position and the advancing element applies pressure to the first side of the collecting device in the engaged position.

27. The system of claim 26, wherein the advancing element is a tire mounted on a rotatable shaft.

28. A method of making booklets, comprising the steps of:

clamping a folded sheet material with a reciprocating transferring device;

delivering the folded sheet material to a pivotable collecting device along an arc established by movement of the transferring device, the folded sheet material being deposited over a supporting edge of the collecting device such that a fold of the folded sheet material is received by the supporting edge;

pivoting the collecting device such that different portions of the folded sheet material are received by different supporting sides of the collecting device, wherein the collecting device pivots to receive the folded sheet material such that: a first portion of the folded sheet material is received on a first supporting side of the collecting device, and a second portion of the folded sheet material is received on a second supporting side of the collecting device, and clamping the folded sheet material on the collecting device with the transferring device, wherein at completion of movement in a first direction along the arc, a first clamping component of the transferring device is positioned on the first supporting side of the collecting device and a second clamping component of the transferring device is positioned on the second supporting side of the collecting device to clamp the sheet on the collecting device.

29. The method of claim 28, wherein the first clamping component is fixed and the second clamping component is displaceable along an axis of the transferring device from a disengaged position to an engaged position to clamp the sheet on the collecting device.

30. A method of making booklets, comprising the steps of:

clamping a folded sheet material with a reciprocating transferring device;

delivering the folded sheet material to a pivotable collecting device along an arc established by movement of the transferring device, the folded sheet material being deposited over a supporting edge of the collecting device such that a fold of the folded sheet material is received by the supporting edge;

pivoting the collecting device such that different portions of the folded sheet material are received by different supporting sides of the collecting device transferring additional folded sheet materials individually to the collecting device along the established arc;

pivoting the collecting device to receive each folded sheet material such that a stack of folded sheet materials is formed on the collecting device; and clamping the folded sheet material on the collecting device with the transferring device, wherein at completion of movement in a first direction along the arc, a first clamping component of the transferring device is positioned on the first supporting side of the collecting device and a second clamping component of the transferring device is positioned on the second supporting side of the collecting device to clamp the stack of folded sheet material on the collecting device.

31. A method of making booklets, comprising the steps of:

clamping a folded sheet material with a reciprocating transferring device;

delivering the folded sheet material to a pivotable collecting device along an arc established by movement of the transferring device, the folded sheet material being deposited over a supporting edge of the collecting device such that a fold of the folded sheet material is received by the supporting edge;

pivoting the collecting device such that different portions of the folded sheet material are received by different supporting sides of the collecting device transferring additional folded sheet materials individually to the collecting device along the established arc;

pivoting the collecting device to receive each folded sheet material such that a stack of folded sheet materials is formed on the collecting device; and clamping the folded sheet material on the collecting device with the transferring device, wherein at completion of movement in a first direction along the arc, a first clamping component of the transferring device is positioned on the first supporting side of the collecting device and a second clamping component of the transferring device is positioned on the second supporting side of the collecting device to clamp the stack of folded sheet material on the collecting device, wherein the first clamping component is fixed and the second clamping component is displaceable along an axis of the transferring device from a disengaged position to an engaged position to clamp the sheet on the collecting device.

* * * * *